United States Patent [19]

Werschnik

[11] 4,245,543

[45] Jan. 20, 1981

[54] CLARINET WITH VARYING DIAMETER OF ITS LONGITUDINAL BORE

[76] Inventor: Alois Werschnik, Mädelegabel-Strasse 57, 8000 Munich 82, Fed. Rep. of Germany

[21] Appl. No.: 895,934

[22] Filed: Apr. 13, 1978

[30] Foreign Application Priority Data

Apr. 15, 1977 [DE] Fed. Rep. of Germany ..... 2716786

[51] Int. Cl.[3] ..... G10D 7/06

[52] U.S. Cl. ..... 84/382

[58] Field of Search ..... 84/382, 380

[56] References Cited

U.S. PATENT DOCUMENTS 2,602,364 7/1952 Loney ..... 84/382

FOREIGN PATENT DOCUMENTS 364648 11/1922 Fed. Rep. of Germany ..... 84/380

2333540 1/1975 Fed. Rep. of Germany ..... 84/382

1137138 5/1957 France ..... 84/382

OTHER PUBLICATIONS

Benade, "On Woodwind Instrument Bores", Journal of the Acoustical Society of America, vol. 31, No. 2, pp. 137-146, 1959.

Benade, "On the Mathematical Theory of Woodwind Finger Holes", Journal of the Acoustical Society of America, vol. 32, No. 12, pp. 1591-1608, 1960.

Nederveen, "Calculators on Locations and Dimensions of Holes in a Clarinet", Acustica, vol. 14, No. 4, pp. 227-234, 1964.

*Primary Examiner*—Lawrence R. Franklin

*Attorney, Agent, or Firm*—Toren, McGeady and Stanger

[57] ABSTRACT

The bore in the upper middle joint of a Boehm type B clarinet has a uniformly cylindrical portion extending from the lower end to a central region, and the bore diameter gradually increases from there to the top end of the upper middle joint by a total of 0.2 to 0.4 mm, the rate of increase being greatest adjacent the central region and decreasing toward the top end.

13 Claims, 7 Drawing Figures

CLARINET WITH VARYING DIAMETER OF ITS LONGITUDINAL BORE

The invention relates to a clarinet with varying diameter of its longitudinal bore.

Several important twelfth tones can be improved substantially by application of the boring principle described in my published German application No. 2,333,540. An attempt at tuning all twelfth tones optimally fails because tones of the high ranges become substantially too low. This shortcoming cannot be overcome by any bore based on the known principle. By far the best solution of the intonation problem could be achieved when the speaker-hole sleeve was extremely reduced in diameter, for example, to 2.3 to 2.5 mm, and set higher. This procedure required a costly supplemental mechanism for the tone b'-flat. The twelfths and the tones of the high range are tuned relatively well in connection with a mouthpiece drilled to extreme width of 15 mm diameter in a cylindrical shape, and a barrel of 15.0 to 15.2 mm diameter. Because of the relatively abrupt steps provided, that is, because of the sudden cylindrical enlargement and constriction in several places of the longitudinal bore, there results a sound which is not particularly well equalized, and long tones particularly do not sound free.

It is the object of the invention to provide a clarinet, particularly a B-flat clarinet, system Boehm, or alternatively an A, D, and E-flat clarinet, in which not only the twelfths and the tones of the high ranges are correctly tuned, but in which also a good, equalized, voluminous sound is achieved in all ranges. Finally, the costly supplemental mechanism for b'-flat is to be avoided.

The problem may be solved according to the invention by various means.

A first solution applies particularly to B-flat clarinets, system Boehm. Let it be assumed that the clarinet consists of equally long sections of 1 cm length, starting with section 0 at the end of the upper middle joint next to the barrel. In the clarinet of this invention, the diameter of the longitudinal bore is constant from the lower end of the upper middle joint at the 22nd section, to the region between the 15th and 10th sections, or increases slightly beginning from the 22nd section to the region longitudinally central between the 15th and 10th sections by an order of magnitude of altogether 10/100 mm (i.e., 0.10 mm). This section is followed upwardly by an enlargement, starting at a point between the 15th and 10th section, whose diameter increases to the upper end of the upper middle joint, to section 0, by between 25/100 and 40/100 mm (i.e., 0.25 mm and 0.40 mm, respectively), and the enlargement is carried out in such a manner that the diameter of the longitudinal bore, beginning from the starting point located between the 15th and the 10th section increases monotonically first more steeply and thereafter at a steadily decreasing rate upward to section 0.

Because of this design, the longitudinal bore of the clarinet is defined by a substantially elliptical bounding curve in the region of the enlargement when viewed in section.

Because space is to be provided for influencing certain tones by the enlargement of the longitudinal bore, this gain in space, which is to be greatest in between the 15th and the 8th section, can be achieved also without giving the bounding curve of the enlargement the shape of an elliptic curve (such as by substituting for the elliptical or kettle-shaped enlargement a conical enlargement, a stepwise enlargement with one or more steps, or a combination of these two possibilities), and by producing the gain in space necessary for affecting the twelfths and the tones of the high range by setting certain tone holes lower and enlarging the tone holes.

The second solution according to the invention, particularly for a B-flat clarinet, system Boehm, thus is characterized in, the average value of the volume of the longitudinal bore including the volume of the tone holes in this region being constant from the lower end of the upper middle joint, the 22nd section, up to the longitudinally central area between the 15th and 8th section, or increasing slightly beginning from the 22nd section up to the region between the 15th and 8th sections corresponding to a diameter increase of a total of 10/100 mm. This section is followed upwardly by an enlargement starting from a point between the 15th and 8th sections, whose volume increase corresponds to a diameter increase of the longitudinal bore, to the upper end of the upper middle joint, the section 0, by 25/100 to 40/100 mm. The enlargement is executed in such a manner that the average value of the volume of the longitudinal bore, including the volume of the tone holes in this region, increases from the starting point of this enlargement located between the 15th and 8th sections at first more strongly, and thereafter at a rate decreasing gradually upwardly up to section 0.

The term "average value of the volume of the longitudinal bore" will be explained now. If the volume of each section of the longitudinal bore is plotted as a function of the section number, the resulting curve has a sudden rise in the region of each tone hole, which rise again subsides at the end of the tone hole. Thus, there results a curve with humps in the regions of the tone holes. If these additional volumes, which are due to the tone holes, are distributed over the volume of the longitudinal bore, a steady curve is obtained which is substantially parallel to that representing the volume of the longitudinal bore without tone holes. If one plots, for example, the volumes of adjoining sections of a longitudinal bore, a straight line is obtained for a cylindrical bore without inclusion of the tone holes. If the volumes of the tone holes are added, another straight line parallel to the first straight line is obtained for a cylindrical longitudinal bore with uniformly distributed tone holes of equal diameter. This other straight line indicates the average value of the volume distribution of individual sections of the longitudinal bore including the tone holes. The course of the curve indicating the distribution of volume may thus be changed not only by changing the diameter of the longitudinal bore, but also by varying the location and magnitude of the tone holes.

It follows that the controlling parameter is not the shape of the bore, but the volume in the region of a specific section of the clarinet if certain tones are to be changed. According to the second solution, the advantageous result which was achieved by means of the kettle-like or elliptical shaping of the longitudinal bore, as viewed in longitudinal section, can also be reached by providing either a conical longitudinal bore or a sequence of differently wide, cylindrical sections, and then determining the tone holes as to magnitude and location. This is done in such a manner that, in the region of certain tones which are to be changed, the same volume is available as that in accordance with the initially described solution in which the longitudinal bore shows an elliptic boundary in the region of the enlargement as viewed in longitudinal section. The boundary line as such is not of first order importance, but the volume resulting from the longitudinal bore in connection with the tone holes is controlling.

The basic principle indicated hereinbefore is also applicable to clarinets shorter than the B-flat clarinets, particularly to E-flat clarinets, but adaptation to the substantially shorter length is required. The solution of the task set initially in clarinets substantially shorter than the B-flat clarinets, particularly in E-flat clarinets, is characterized in that, with the clarinet divided into individual sections each one cm long, beginning with the upper end of the mouthpiece channel as section 0, the diameter of the longitudinal bore in the upper middle joint, starting from the lower end adjacent the lower middle joint up to the region between the 15th and 10th section, is constant or increases slightly, starting from the lower end of the upper middle joint to the region between the 15th and 10th sections by an order of magnitude of a total of 10/100 mm. This area is followed upwardly by an enlargement of the diameter of the longitudinal bore, starting from a point between the 15th and 10th sections, or between the tone holes of the tones f' to a'. The increase of the diameter of the longitudinal bore up to the upper end of the mouthpiece channel, the section 0, amounts to between 20/100 to 35/100 mm. The enlargement is executed in such a manner that the rate of increase in the diameter of the longitudinal bore beginning with the starting point of the enlargement located between the 15th and 10th sections is at first steeper, and decreases steadily upward to the section 0. The shape of the longitudinal bore, for example, in an E-flat clarinet, a relatively short clarinet, is entirely comparable with the shape of the longitudinal bore of a B-flat clarinet if one compares the longitudinal bore of the E-flat clarinet or in a D clarinet up to and including the upper end of the mouthpiece channel with the longitudinal bore of the B-flat clarinet to the upper end of the upper middle joint, always calculating from the respective lower ends of the upper middle joint.

It is essential to all kinds of solutions that an increase in volume of the space composed of the longitudinal bore and the tone holes starts between the 15th and 8th sections of the upper middle joint in B-flat clarinets or between the 15th and the 10th sections of the clarinet in E-flat clarinets, and that the increase in volume has a greater gradient in the lower region than in the upper region.

A further development of the invention resides in that the increase in diameter or volume enlargement in the lower area is greater with a higher starting point of the enlargement than with a starting point located lower, and that the bounding curve of the longitudinal bore is steeper in the upper region, or the increase in the average value of the volume of the longitudinal bore is smaller than with a starting point located lower.

A particularly advantageous development of the invention is to be seen from the fact that the uniformly narrow area between the 22nd section and a point between the 15th and 8th sections, or the 10th section in E-flat clarinets, constitutes the narrowest area of the clarinet.

Particularly good results having advantageous effects on the intonation and on the sound of the clarinet are achieved according to the invention by a barrel having the same diameter as section 0 of the upper middle joint and a length shorter by about 2 to 8 mm than would be necessary for purely tuning the notes b'-flat, a', a'-flat, g', f'-sharp, and f' to a basic pitch of a/880 to a/890 oscillations, and is so dimensioned in its length that the tones located in the area of uniform, narrowest cross section from the 22nd section to a point, between the 15th and 8th section are tuned approximately correctly. Further, the tone holes of the tones b'-flat, a', a'-flat, g', f'-sharp shake, f' and optionally also e', which are located in the region between the 8th and 16th sections, are shifted down by 2 to 8 mm in such a manner that the tone holes are shifted further downward for a higher starting point for the enlargement of the longitudinal bore beginning between the 15th and 8th sections, and vice versa.

Because of the great enlargement beginning at a point between the 15th and 8th sections, the clarinet as a whole becomes higher wherefore one should actually employ a longer barrel in order to make the particularly affected tones b'-flat, a', a'-flat, g', f'-sharp, f'-sharp shake, and f' tuned pure. This, however, would require larger tone holes in the region between the 15th section of the upper middle joint and the 33rd section in the lower middle joint, counting from section 0 of the upper middle joint. To avoid this measure, the barrel is shortened, so that the sounds are right in the region between the 15th and 22nd sections with medium diameters of the tone holes. The lack of harmony in the region of the enlargement, that is, approximately between the section 13 and the section 0, is compensated by a lower setting of the speaker-hole sleeve and of the further tones mentioned above, that is, a', a'-flat, g', f'-sharp, f'-sharp shake, f', and optionally e'. A lower setting of the tone hole e' is resorted to less because of the space enlargement resulting from this lower setting in conjunction with an enlargement of the tone hole, but in order to establish the proper distance to the lower-set speaker-hole sleeve which affects the twelfth h'' of the tone e' and because of the sound.

A further measure of the invention which relates to the proper tuning of the twelfths and of the tones of the high range and has a beneficial effect on the sound consists in that the size of the tone holes increases with increasing shifting of the tone holes of the tones b'-flat, a', a'-flat, g', f'-sharp, f'-sharp shake, f', and e', and vice versa.

If a clarinet is built according to the measures indicated above, that is, if the volume is enlarged starting beginning at a starting point between the 15th and 8th section, the rate of enlargement being greater at first, but the rate of diameter increase declining gradually in an upward direction, and if one gives the region of the bore between the lower end and the starting point of the enlargement as the narrowest cross section, and the barrel is provided with such a length that the tones are approximately correct in the narrowest region, and thereafter the tones a', a'-flat, g', f'-sharp, f'-sharp shake, f', and e' are shifted downward for pure tuning of the twelfths and of the tones of the high range, it is recommended to shift the speaker-hole sleeve downward corresponding to the shift of the tone holes for the tones a', a'-flat, g', f'-sharp, f'-sharp shake, f', and e', the amount of shifting decreasing with increasing enlargement of the mouth piece with constant diameter of the speaker-hole sleeve.

The shorter the barrel is selected, or the greater the enlargement of the upper middle joint, the lower the afore-mentioned tones b'-flat, a', a'-flat, g', f'-sharp, f'-sharp shake, f', and e' are located. This change is not without influence on certain tones in the lower middle joint of the clarinet, and the tones down to about the 36th section become relatively too high. Obviously, the same division into sections is selected in the lower middle joint, that is, the lower middle joint adjoins with its section 23 the section 22 of the upper middle joint, each section corresponding to a distance of one cm.

In order to restore equalization of the length relationship of the tones in the lower middle joint to the lowered tones in the upper middle joint, that is, the tones a′, a′-flat, g′, f′-sharp, f′-sharp trill, f′, that is, in order to compensate for the afore-mentioned reaction on the tones in the lower middle joint, it is recommended, according to a further development of the invention, to shift the tone holes in the lower middle joint downward beginning with the section adjoining the 22nd section of the upper middle joint to the 36th section, or down to approximately including the tone hole for the tone g, with the exception of the tone hole for the tone c′ whose spacing from the tone hole of the tone f′ amounts to about 92 mm, approximately by the amount of shortening of the barrel, or by the amount of lowering of the tone holes for the tones b′-flat, a′, a′-flat, f′-sharp, f′-sharp shake, f′, and e′.

Another possibility of solving the task set initially resides in the barrel bore at the reference having the same diameter as the point in section 0 of the upper middle joint and optionally being enlarged somewhat toward the mouthpiece and having a length greater by about 2 to 8 mm than would be necessary for a pure tuning of the tones to a basic pitch of a/880 to a/890 oscillations, that the tone holes of the tones b′-flat, a′, a′-flat, g′, f′-sharp, f′-sharp shake, f′, and optionally e′ remain in the respective positions with which they are associated for a barrel tuned to the corresponding basic tuning, but that the diameters of the tone holes for the tones a′, a′-flat, g′, f′-sharp, f′-sharp shake, f′, and optionally e′ are enlarged so that the corresponding tones are again correct with the lengthened barrel. Further, all tone holes from the 15section to the lower end of the clarinet are shifted upward in accordance with the lengthening of the barrel, the diameters of the tone holes retaining their magnitudes, which are established for a barrel tuned to the appropriate basic tuning and not lengthened. This measure is also bounded on the basic principle of the invention which resides in gaining substantial space in the region above a point located between the 15th and 8th sections and upward, with the gain in space increasing more strongly in the lower region of the enlargement and becoming steadily smaller in an upward direction. This gain in space is to be relatively large as compared to the narrowest bore located in the region between the 22nd section and a point between the 11th and 8th sections, and amounts to an increase in the diameter of the longitudinal bore of 25/100 to 40/100 mm, starting from a clarinet with a medium tone hole diameter.

All the measures described above which supplement each other have a favorable effect on the tuning, on the sound, and on the sound volume of the clarinet.

The sound volume and the homogeneity of the sound in all registers may be improved further according to an additional development of the invention by the longitudinal bore being free from abrupt steps and diameter changes. The provided diameter changes thus are to be achieved, as far as possible, not by cylindrical steps, but by smooth transitions.

When a mouthpiece with conical bore is employed, the barrel may be enlarged slightly toward the mouthpiece, as compared to a clarinet with cylindrical mouthpiece.

It is unavoidable that, with the use of a mouthpiece with conical bore, the diameter of the speaker-hole sleeve is arranged lower as compared to a clarinet with cylindrical, and thus wider mouthpiece, and provided with a larger diameter.

Further advantages, features, and details of the invention will be evident from the following description in connection with the drawing in which the invention is illustrated by way of example. In the drawing.

Figure 4A:
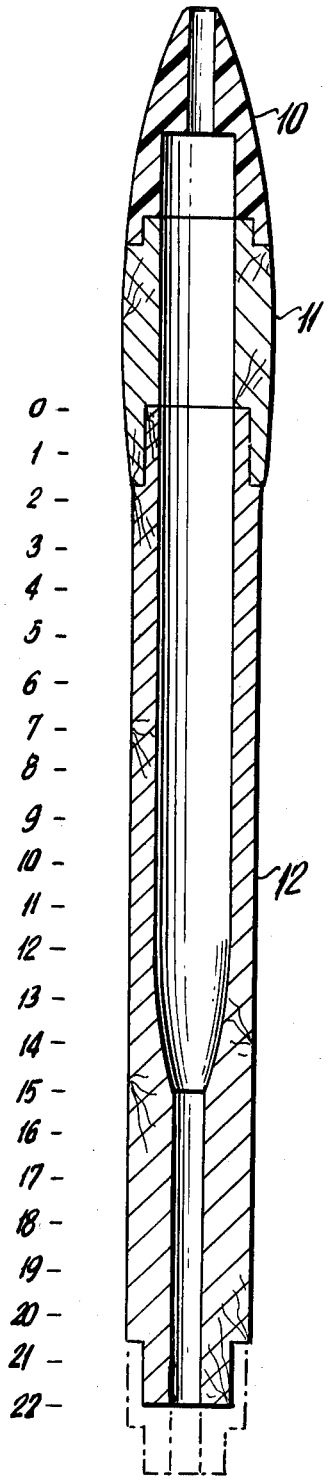
Figure 4B:
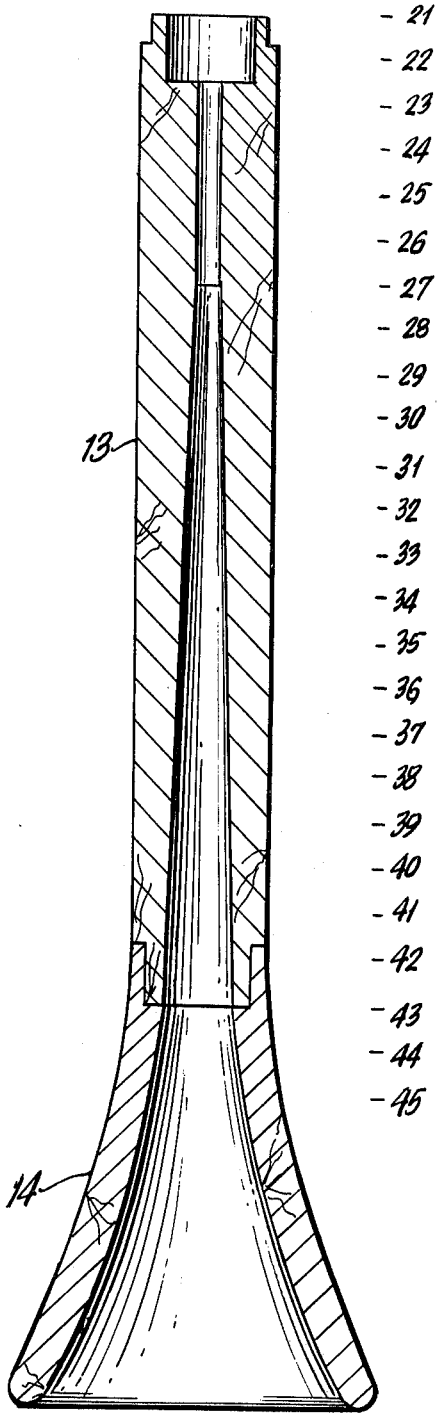
Figure 5A:
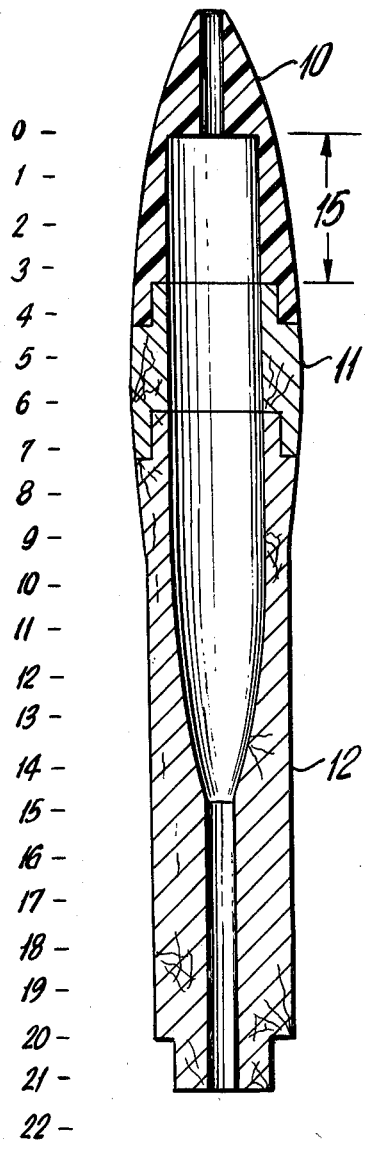
Figure 5B:
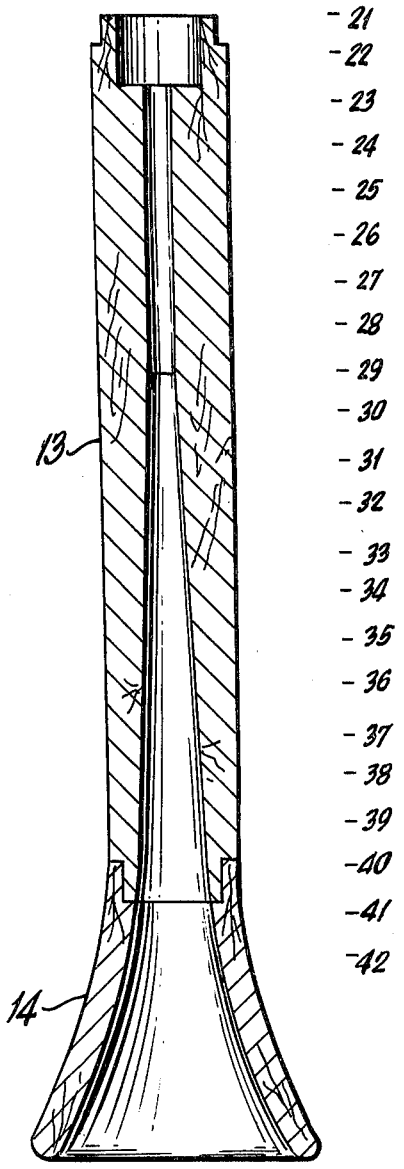

FIGS. 4*a* and 4*b* represent the entire construction of the B-flat and A-flat clarinets; and FIGS. 5*a* and 5*b* illustrate the entire construction of the E-flat clarinet.

In the representation of the contours of the longitudinal bores, only the right contour of a section being illustrated in each instance, the diameter differences of adjoining sections are shown enlarged on a scale of 1:200, whereas the scale in the direction of length has been selected 1:1.

Figure 1:
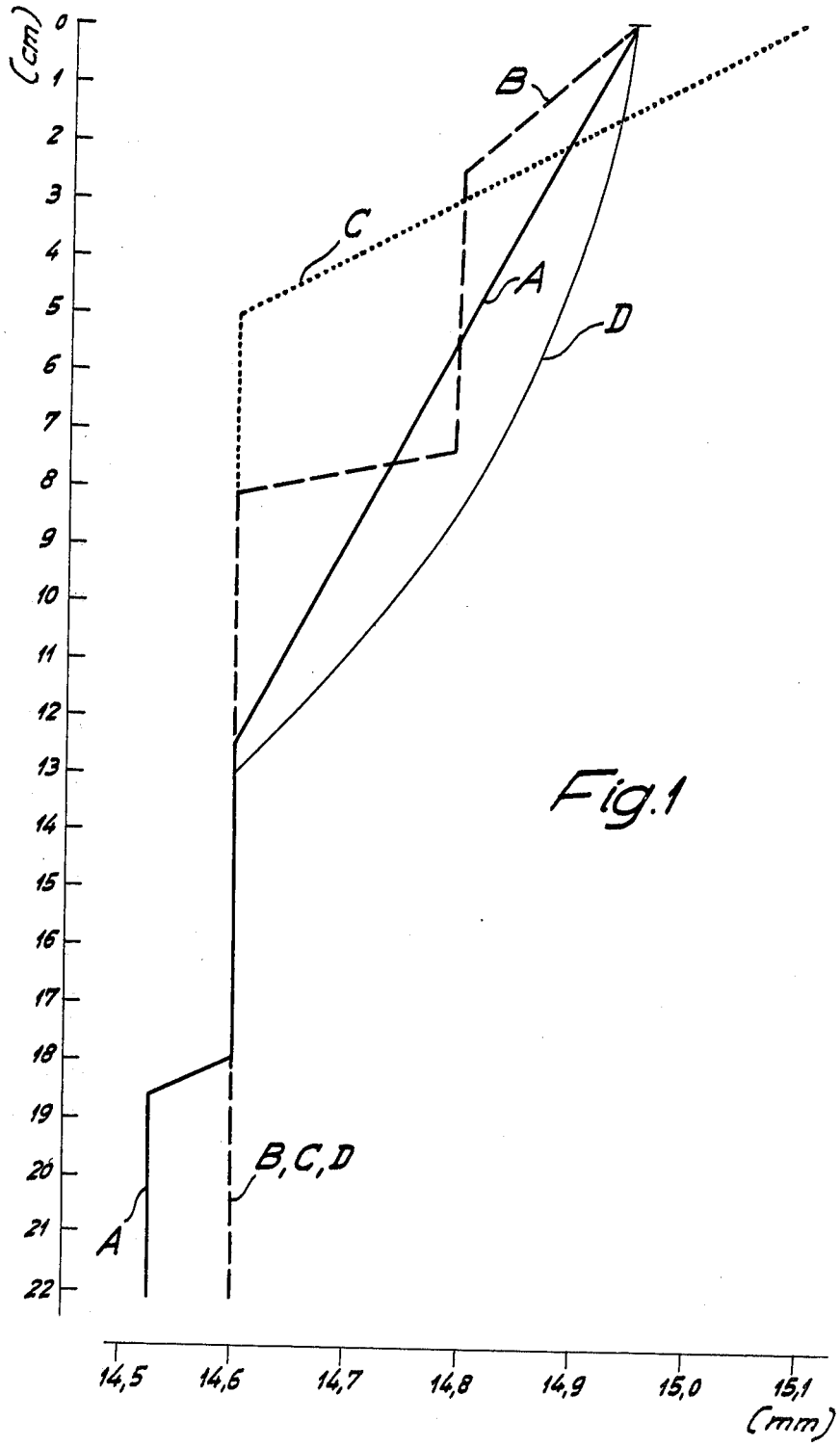
FIG. 1 shows various cross-sectional shapes of the upper middle joints of three known clarinets and of an embodiment of a clarinet according to the invention in half-section, that is, only the respective right, internal boundaries of the sectioned longitudinal bores are shown.

In FIG. 1, there are represented the right, respective boundary lines of the longitudinal bores of four upper middle joints of four different B-flat clarinets, the known bores being designated A, B, and C, whereas the bore of the shape according to the invention is designated D. The upper middle joint, or the entire clarinet is subdivided into individual sections for a better understanding, each section being one cm long. The upper middle joints thus begin with section 0 and range to section 22.

The known bore A has a width of 14.95 mm at the section 0, that is, at its upper end to which the barrel is joined. From this width, the bore tapers uniformly and conically to section 12.5 to a width of 14.60 mm. The bore is shaped cylindrically from section 12.5 to the section 18. Here, a step is provided, and the bore is reduced to a width of 14.48 mm. From section 18 to section 22, the bore is again cylindrical.

Bore B also has a width of 14.95 mm at section 0. The bore tapers conically to section 2.5, the bore being reduced to a width of 14.80 mm. There follows a cylindrical section which extends from section 2.5 to section 7.5. At section 7.5, the bore is reduced in a step from a value of 14.80 mm to a width of 14.60 mm. From section 7.5 to the end of the upper middle joint, the bore is uniformly cylindrical.

The third known bore C has a width of 15.10 mm at the section 0 and uniformly, conically tapers to section 5 to a value of about 14.50 mm. From this section 5 to the end of the upper middle joint the bore is uniformly cylindrical.

The bore D according to the present invention is shaped uniformly cylindrically in the region from section 22 to the section 13 and has a diameter of 14.60 mm. This is followed by a substantially elliptic or kettle-shaped boundary of the bore which shows a relatively great increase in diameter per longitudinal section in its lower region, that is, from the 13th to approximately the 7th section, whereas this increase in diameter steadily becomes smaller upwardly to the section 0. At the section 0, the bore D has a diameter of 14.95 mm.

The spacings of the tone holes from the upper rim of the upper middle joint are indicated in the appended Table 1 both for the clarinet of the invention whose bore is designated D in FIG. 1 and for the known clarinet whose bore is designated B in FIG. 1.

The spacings of the tone holes in the lower middle joint, that is, in the 24th to 36th sections, are located lower by about 1 mm to 4 mm than in the known clarinet which, however, depends on the length of the barrel. Both clarinets have medium-sized tone holes. The distances from the top rim of the upper middle joint are each measured to the center of the tone hole. The tone holes for the tones f-sharp and f make an exception by being located higher by 3 and 10 mm respectively than the corresponding tone holes f-sharp and f in the known clarinet.

Figure 2:
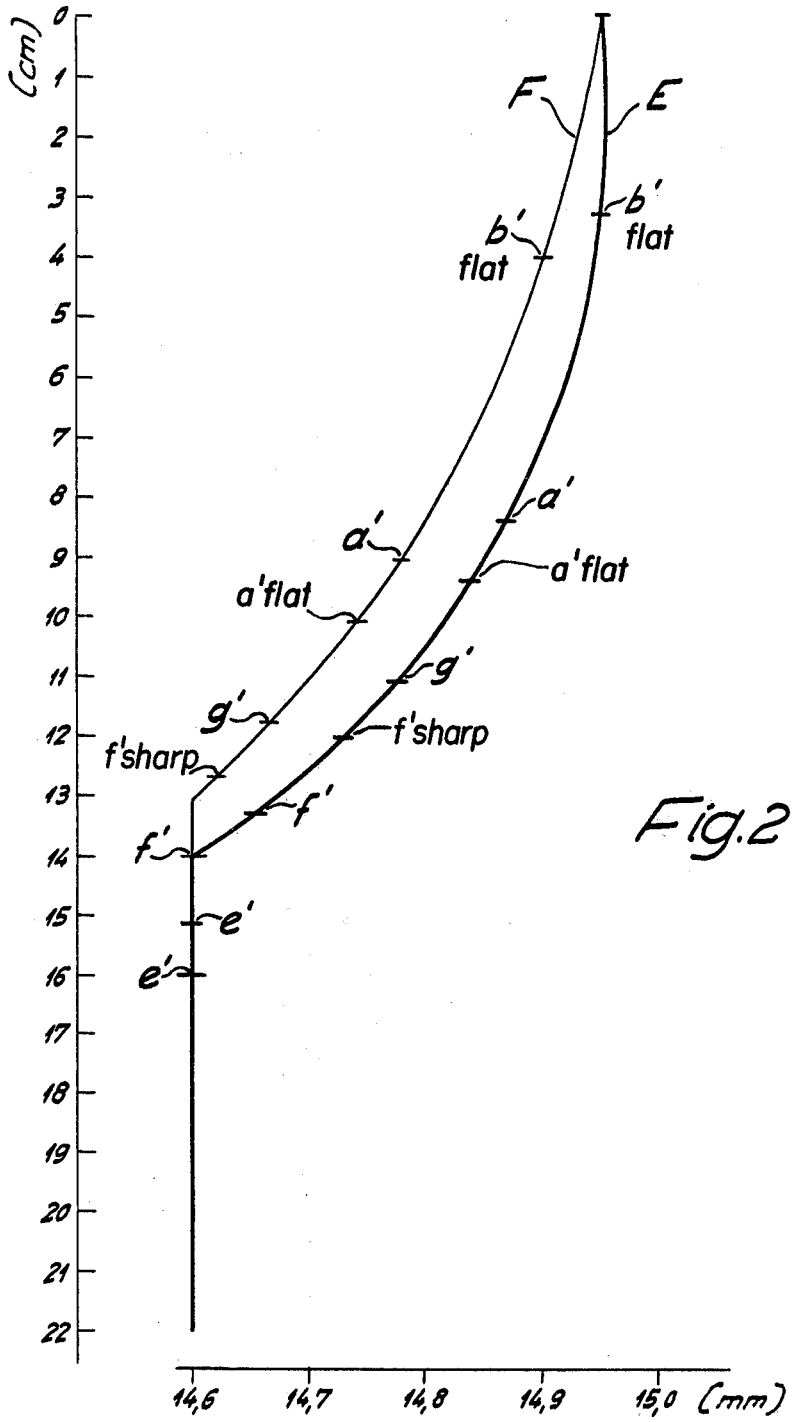
FIG. 2 illustrates the cross-sectional shape of two basic embodiments of longitudinal bores of B-flat clarinets according to the invention, again only the right half of the bore boundary being shown.

FIG. 2 shows the bore course of the longitudinal bores of two B-flat clarinets according to the invention. Curve E shows a longitudinal bore in which the tone holes of the tones b'-flat, a', a'-flat, g', f'-sharp, f'-sharp shake, f', and e' have the same spacing from the upper rim of the upper middle joint as is the case in the known clarinet B in FIG. 1. The tone holes of the mentioned tones thus are not offset downward as compared to the known clarinet which represents a certain standard measure. The tone holes for tones b'-flat, a', a'-flat, g', f'-sharp, f'-sharp shake, and e' in the second clarinet whose curve bounding the longitudinal bore is designated F are shifted downward by about 5 to 9 mm as compared to the tone holes of the clarinet of bore E, the shift being not equally great with all tone holes. The clarinet of bore F has a shorter barrel than the clarinet of bore E because of the tone holes set lower.

As is noted in a comparison of these two curves which indicate the course of the bores, the starting point of the enlargement is lower in the bore E by one section, or one cm, than in the bore F. The increase in diameter of the individual sections in the lower region is substantially greater in the bore E than in the bore F. This direct comparison gives an impression as if the clarinet of bore E would provide a greater volume for the development of oscillations of the individual tones than the clarinet of bore F. Actually, however, an additional gain in space in this region has been created by the shifting of the tone holes of tones b'-flat, a', a'-flat, g', f'-sharp, f'-sharp shake, f', and e' by the lower location of the tone holes which are enlarged in their diameters because of the downward shift. Because of this measure, substantially the same volume is created despite the smaller enlargement in the region between the 8th and 14th sections if not only the volume of the longitudinal bore is considered, but the volume of the tone holes is added. Accordingly, similar results are achieved despite a different arrangement of the longitudinal bores. Values of diameters in mm are indicated on the abscissa for an exact comparison of the two bores. The bore F, with a corresponding correction of the height of the tone holes could be replaced by a conical bore, or it would be possible to set the starting point of the enlargement still higher up, for example, at the 8th or the 5th section and then to provide a suitably large step. The resulting loss of space would have to be compensated to some extent by tone holes set even lower and of still greater diameter.

Figure 3:
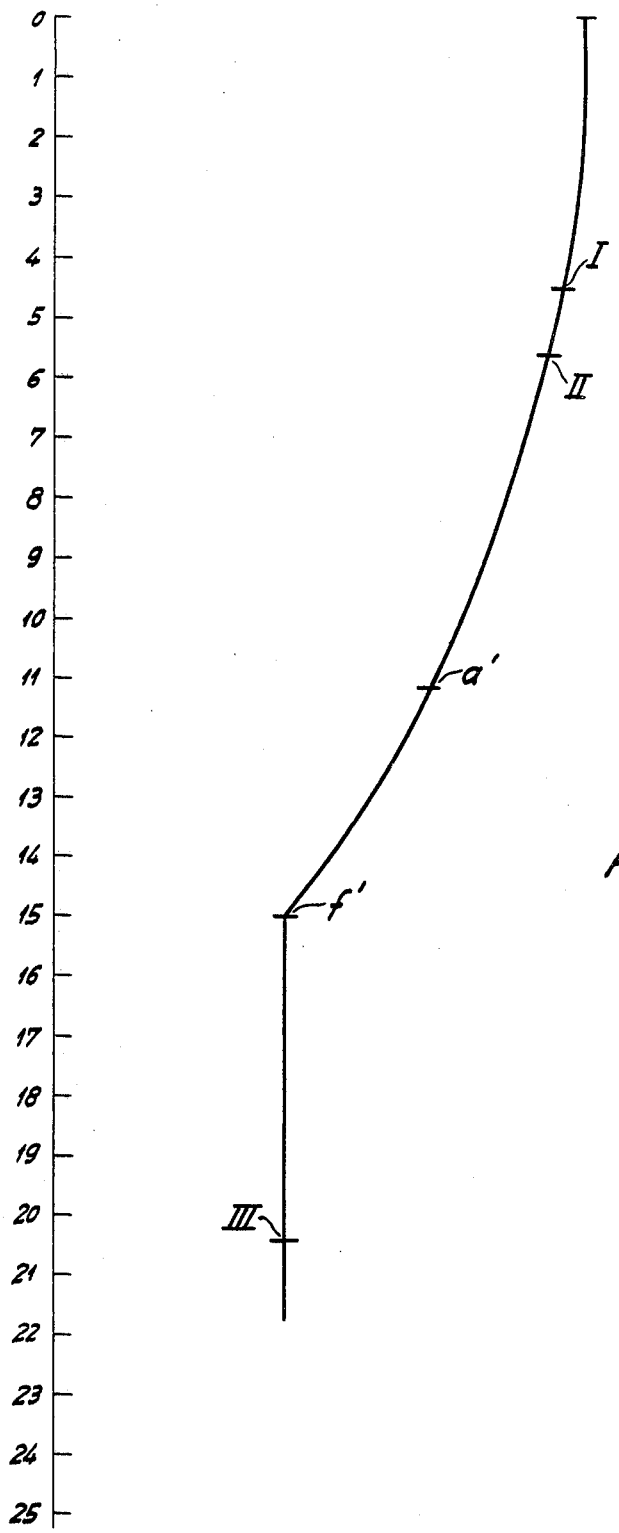
FIG. 3 shows the right half of the bore boundary of the longitudinal bore of an E-flat clarinet according to the invention.

The course of the bore in an E-flat clarinet is represented in FIG. 3. The starting point of the enlargement in this clarinet too is provided in approximately the same region as in the B-flat clarinets of FIG. 2, and the bore below the point at which the enlargement starts is also cylindrical as in the B-flat clarinets of FIG. 2 to the end of the upper middle joint which extends in the B-flat clarinets to the section 22, in the E-flat clarinet, however, only to the section 20.5. The course of the enlargement corresponds as to increase in diameter per section approximately to the course of the longitudinal bore F of the B-flat clarinet according to FIG. 2. The difference from the B-flat clarinet, however, is in the fact that the increase in the enlargement continues to the end of the mouthpiece channel. The E-flat clarinet according to FIG. 3, as the B-flat clarinet according to FIG. 2, is subdivided into individual sections having respective lengths of one cm. Whereas the division of the B-flat clarinets begins at the upper rim of the upper middle joint, the division in the E-flat clarinet begins at the upper end of the mouthpiece channel, that is, the enlargement extends to the upper end of the mouthpiece channel. This change is required because of the shorter length of the E-flat clarinet as compared to the B-flat clarinets. The tone holes for the tones a' and f' are indicated in FIG. 3 for comparison with the B-flat clarinets. Additionally, the lengths of the mouthpiece channel, of the barrel and of the upper middle joint are seen. The upper end of the mouthpiece channel starts at the section 0, and the mouthpiece channel extends to the section 4.5. The barrel extends to the section 5.6. The upper middle joints of the clarinet extends from section 5.6 to the section 20.5. Short transverse lines are entered in the curve in the mentioned spots. The lower end of the mouthpiece channel is designated I, the lower end of the barrel II, and the lower end of the upper middle joint III in order better to emphasize the lengths of these parts.

TABLE I

| Tone hole | Spacing of the tone holes from the upper end of the upper middle joint, mm | |
|---|---|---|
| | Bore D | Bore B |
| b'-flat | 39 | 33 |
| a' | 89 | 84 |
| a'-flat | 99 | 94 |
| g' | 116 | 111 |
| f'-sharp and f'-sharp shake | 125 | 120 |
| f' | 138 | 133 |
| e' | 156 | 151 |
| e' (b''-flat) | 166 | 166 |
| e'-flat | 170 | 168 |
| e'-flat shake | 170 | 170 |
| d' | 188 | 189 |
| c'-sharp | 199 | 199 |
| c' | 229 | 231 |
| b | 246 | 248 |
| b-flat | 273 | 271 |
| a | 296 | 294 |
| a-flat | 329 | 327 |
| g | 355 | 354 |
| f-sharp | 383 | 386 |
| f | 415 | 425 |

Reference to FIGS. 4*a* and 4*b*, shows an illustration of B-flat and A-flat clarinet construction in accordance with the present invention. In FIG. 4*a*, both the A-flat and B-flat clarinet have the same reference point (marked "0"). A mouthpiece 10 is joined to a barrel joint 11 which in turn is coupled to an upper joint 12. The A-flat clarinet is shown with dashed lines since it is longer than the B-flat clarinet. The remainder of the clarinet is shown in FIG. 4*b* where a lower joint 13 is connected to bell 14.

In FIGS. 5*a* and 5*b*, reference numerals correspond to the same parts as in FIGS. 4*a* and 4*b*. What is shown here is an E-flat clarinet. The reference point "0" is at the upper end of the mouthpiece channel 15.

I claim:

1. An upper middle joint for a B-flat clarinet with varying diameters of the longitudinal bore, comprising:

said joint consisting of sections of one centimeter in length as measured from zero at the top of said joint;

said bore being of constant diameter from the twenty-second section up to a point between the fifteenth and tenth sections;

said bore having an enlarged portion extending from said point to the zeroth section, said enlarged portion consisting of an upper region and a lower region; and the diameter of said enlarged portion increasing monotonically from said point upwardly to said zeroth section, the rate of increase per longitudinal section of said diameter being relatively great in said lower region and steadily decreasing in said upper region, the total increase in diameter from said point to said zeroth section being between 0.25 millimeters and 0.40 millimeters.

2. An upper middle joint for a B-flat clarinet with varying diameters of the longitudinal bore, comprising:

said joint consisting of sections of one centimeter in length as measured from zero at the top of said joint;

The diameter of the bore increasing slightly by a total value of 0.10 millimeters from the twenty-second section up to a point between the fifteenth and tenth sections;

said bore having an enlarged portion extending from said point to the zeroth section, said enlarged portion consisting of an upper region and a lower region; and the diameter of said enlarged portion increasing monotonically from said point upwardly to said zeroth section, the rate of increase per longitudinal section of said diameter being relatively great in said lower region and steadily decreasing in said upper region, the total increase in diameter from said point to said zeroth section being between 0.25 millimeters and 0.40 millimeters.

3. An upper middle joint for a B-flat clarinet with varying diameters of the longitudinal bore, comprising:

said joint consisting of sections of one centimeter in length as measured from zero at the top of said joint;

said bore having a constant average value of the volume between the twenty-second section and a point between the fifteenth and the eighth sections;

said bore having an enlarged portion extending from said point to the zeroth section, said enlarged portion consisting of an upper region and a lower region; and the average value of the volume of said enlarged portion increasing per longitudinal section at a relatively greater rate in said lower region than in said upper region, said rate steadily decreasing in said upper region.

4. An upper middle joint for a B-flat clarinet with varying diameters of the longitudinal bore, comprising:

said joint consisting of sections of one centimeter in length as measured from zero at the top of said joint;

said bore having an average value of the volume which increases slightly from the twenty-second section to a point between the fifteenth and the eight sections, said increasing average value of the volume corresponding to an increase in diameter of the bore of about 0.10 millimeters;

said bore having an enlarged portion extending from said point to the zeroth section, said enlarged portion consisting of an upper region and a lower region; and the average value of the volume of said enlarged portion increasing per longitudinal section at a relatively greater rate in said lower region than in said upper region, said rate steadily decreasing in said upper region.

5. An upper middle joint as in claim 1, 2, 3, or 4 wherein the length of the upper region is about the same as the length of the lower region.

6. An upper middle joint as in claim 5 wherein said lower region extends from the thirteenth section to the seventh section and said upper region extends from the seventh section to the zeroth section.

7. An upper middle joint as in claim 1, 2, 3, or 4 wherein the diameter of the twenty-second section constitutes the smallest diameter of the bore.

8. An upper middle joint as in claim 1, 2, 3, or 6 wherein the bore is free from abrupt steps and changes in diameter.

9. An upper middle joint as in claim 3 or 4 wherein each average value of the volume includes the volume of the tone holes.

10. An E-flat clarinet consisting of a mouthpiece, a barrel, an upper middle joint a lower middle joint and a bell, each having a longitudinal bore extending therethrough, wherein the improvement comprises:

the length of said longitudinal bore consisting of sections, each section being one centimeter long, as measured from zero at the upper end of the mouthpiece channel;

the diameter of the bore increasing slightly by a total value of 0.10 millimeters from the twenty-second section up to a point between the fifteenth and tenth sections;

said bore having an enlarged portion between said point and the zeroth section, said enlarged portion consisting of an upper region and a lower region; and the diameter of said enlarged portion increasing monotonically from said point upwardly to said zeroth section, the rate of increase per longitudinal section of said diameter being relatively great in said lower region and steadily decreasing in said upper region, the total increase in diameter from said point to said zeroth section being between 0.20 millimeters and 0.35 millimeters.

11. An E-flat clarinet consisting of a mouthpiece, a barrel, an upper middle joint, a lower middle joint and a bell, each having a longitudinal bore extending therethrough, wherein the improvement comprises:

the length of said longitudinal bore consisting of sections, each section being one centimeter long, as measured from zero at the upper end of the mouthpiece channel;

said bore being of constant diameter from the twenty-second section up to a point between the fifteenth and tenth sections;

said bore having an enlarged portion between said point and the zeroth section, said enlarged portion consisting of an upper region and a lower region; and The diameter of said enlarged portion increasing monotonically from said point upwardly to said zeroth section, the rate of increase per longitudinal section of said diameter being relatively great in said lower region and steadily decreasing in said upper region, the total increase in diameter from said point to said zeroth section being between 0.20 millimeters and 0.35 millimeters.

12. A clarinet as in claim 10 or 11 wherein the diameter of the twenty-second section constitutes the smallest diameter of the bore.

13. A clarinet as in claim 10 or 11 wherein the bore is free from abrupt steps and changes in diameter.

* * * * *